US006036522A

United States Patent [19]

Holzer

[11] Patent Number: 6,036,522

[45] Date of Patent: Mar. 14, 2000

[54] SHOCKPROOF AND TOUCH-SAFE LAMP HOLDER AND ADAPTER SYSTEM FOR LAMPS

[76] Inventor: Walter Holzer, Drosteweg 19, D-88709 Meersburg, Germany

[21] Appl. No.: 08/831,903

[22] Filed: Apr. 2, 1997

[30] Foreign Application Priority Data

Feb. 21, 1997 [DE] Germany ..... 197 07 048

[51] Int. Cl.[7] ..... H01R 13/62

[52] U.S. Cl. ..... 439/306; 439/615

[58] Field of Search ..... 439/306, 307, 439/309, 611–615, 699.2

[56] References Cited

U.S. PATENT DOCUMENTS

| | | | |
|---|---|---|---|
| 625,903 | 5/1899 | Schirner | 439/699.2 |
| 1,125,143 | 1/1915 | McLaughlin | 439/307 |
| 1,506,184 | 8/1924 | Kellner | 439/307 |
| 1,675,353 | 7/1928 | Kellner | 439/307 |
| 1,776,506 | 9/1930 | Houghton | 439/307 |
| 1,932,132 | 10/1933 | Cherry | 439/306 |
| 4,183,604 | 1/1980 | Tjornhm, Sr. | 439/306 |

*Primary Examiner*—Hien Vu

*Attorney, Agent, or Firm*—Marshall, O'Toole, Gerstein, Murray & Borun

[57] ABSTRACT

A shockproof (touch-safe) lamp holder and adapter system which replaces conventional screw-type holders and bayonet holders is disclosed. The lamp holder complies with the list of requirements demanded by testing authorities for many years.

The new lamp sockets can be used with an adapter in conventional lamp holders, and the requirement that the adapter cannot be removed again after insertion without any tools is fulfilled by a reversing lock.

5 Claims, 6 Drawing Sheets

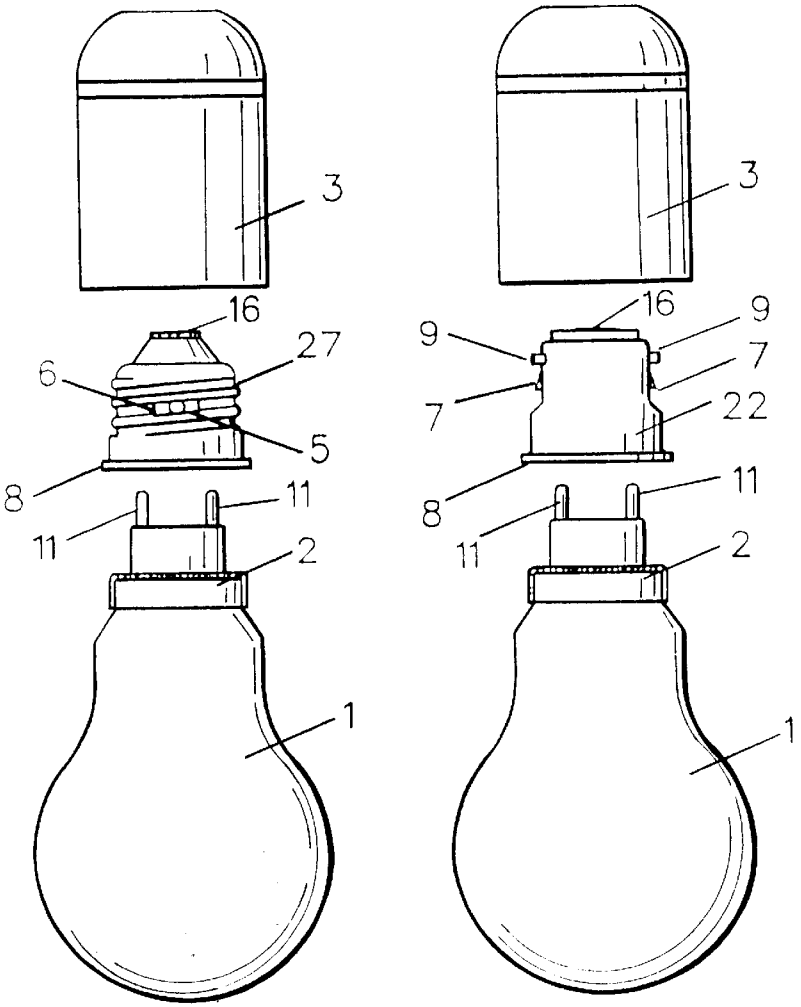
FIG. 1
FIG. 2
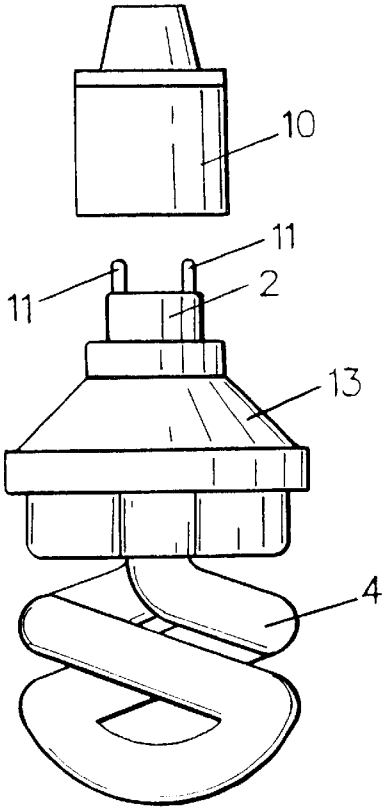
FIG. 3

SHOCKPROOF AND TOUCH-SAFE LAMP HOLDER AND ADAPTER SYSTEM FOR LAMPS

BACKGROUND OF THE INVENTION

The urgent need for introducing a touch-safe or electrically shockproof lamp holder to replace the existing screw-type or bayonet fittings which are currently in use has existed for decades. These lamp holders are an extreme shock hazard when contacted, and there have been countless accidents in the course of time, some of them with deadly consequences.

A design for a new lamp holder has already been on the list of requirements of the VDE and many other testing authorities for many years, particularly because of the likely problems during the transition period to a new system.

Consequently, a new lamp holder system must not only be shockproof, but it also must necessarily be capable of being fitted into the existing conventional lamp holders by means of an adapter. It cannot be expected that the billions of existing lamp fittings can be exchanged all at once.

New, touch-safe lamp holders can only be provided for new lamps. If the quick transition to a shockproof system, which has been desirable for many years, is to be achieved, then this is only feasible, if, from a certain date, the production of lamps is converted to exclusive manufacture of touch-safe lamp holders and sockets, with simultaneous creation of the adapters required for existing lamp sockets.

BRIEF SUMMARY OF THE INVENTION

The task of the present invention is to develop a touch-safe lamp holder 20system which satisfies all of the requirements of the testing authorities, and which is capable of replacing all of the existing screw-type (Edison) lamp holders E27 and E14 as well as the bayonet lamp holders B22 and B15.

According to the invention, this can be achieved by a touch-safe lamp holder which is designed and developed in such a way, that it can be fitted as an adapter in conventional, non-shockproof holders, whereby the adapter has a reversing lock which prevents unscrewing or at least makes it difficult to remove the adapter by a reversal of rotation after it has been fitted into the non-shockproof (non-touch-safe) lamp holder.

With screw-type lamp holders (i.e., Edison sockets) this is achieved by a locking element, e.g. in the form of a cylinder or a ball (5), which engages into a spiral track (33) if one attempts to unscrew the adapter. In such an event, ball (5) is then pressed radially into the inside face (28) of the screw-type thread, and prevents or at least makes difficult the unscrewing of the adapter by means of friction locking.

This locking action is position-independent and is enhanced by a spring (26) which presses the locking element against the direction of rotation of the reversing motion and the adapter is jammed in the lamp holder under friction lock.

Another embodiment of the reversing lock according to the invention is proposed by way of a flat spiral spring, which can yield against the spring-loading when the adapter is screwed into the screw-type socket, but which locks into the inside thread of the holder if an attempt is made to unscrew the adapter, and thus foils any unscrewing.

Another assurance according to the invention against unscrewing consists of a rigid lever, which is secured eccentrically and swivelably in the adapter, protruding from a window of the threaded sleeve of the adapter and can move backward by compression when the adapter is screwed in, but when the adapter is unscrewed, it is jammed and thus hindered in the lamp holder with friction lock.

Naturally, it applies to all the solutions listed here that the locking or braking components penetrate through a window from the inside space of the adapter into the region of the non-shockproof lamp holder to be protected.

However, since the adapter has to be removable from the old lamp holder if the lamp has to be dismantled, the invention proposes for screw-type sockets to provide openings (38) in the front plate (8) of the adapter, through which the locking element of a fitted adapter can be unlatched with a special tool (29), by pushing the locking element back with the tool (29) against the force of the spring (26), thereby inactivating the reversing lock.

For bayonet holders, the solution according to the invention provides for a radially movable latch (7) which, assisted by the pressure of a spring (34), snaps into the axially parallel guide slot (39), after the adapter is inserted into this guide slot, as soon as the required turning motion, which is necessary for the latching of the bayonet socket, has been carried out.

Since such a radially movable latch (7) projects out of the adapter's body perimeter, according to the invention it is recommended to provide a beveled face (36) on the latch (7), which pushes it into the adapter when the adapter is inserted.

As is the case with respect to adapters for screw-type threads, according to the invention it is also recommended to provide windows in the outside wall of the adapter for bayonet sockets, and, when the adapter is in place, to introduce through these windows a spring-loaded latch (7) which acts as a reversing lock, and which can likewise only be retracted by means of a special tool (29).

Since the invention is not limited to only one type of holder, but should also be functional as an overall solution, i.e. also as a system for the smaller types of holders E14 and B15, according to the invention it is proposed to develop the touch-safe lamp holder as a space-saving plug-and-socket connector with hollow pins.

The hollow pins (11) with a stem press section are combined e.g. with spring-loaded Lyra contacts (25), which provide the contact as well as the latching function.

According to the invention, such contacts can also be so designed that they serve as screwless terminals for connecting power source wires.

In order to ensure a trouble-free application of the new lamp holder system, it is proposed to provide a coding system as a protection against a mix-up with reference to voltage, wattage and/or dimmer ability according to the invention.

Such coding can be achieved either through battens or grooves on the lamp socket perimeter, or through openings in the center of the center axis with matching pegs.

This space-saving design as a pin-type socket allows for the fitting of further additional pins, even for the larger two-pole lamp holders E27 and B22, without going below the permissible distance between the current carrying components.

The key to replacement of previous lamp holders with the new system is the inventive solution of a geometric design for the touch-safe lamp holder which allows it to be fitted into the sockets of the non-shockproof lamp holders that are to be replaced.

A further embodiment of the invention consists of a design where the reversing locks are arranged in diametrically opposed pairs.

For heavier lamps it is recommended to provide, in addition to, or as a replacement for, the latching at the hollow pins, a mechanical latching which has a spring in the form of a plastic catch in the lamp holder with corresponding detents at the lamp socket.

The adapter system allows for the use of smaller sockets in the conventional E27 and B22 lamp holders, or larger touch-safe sockets in E14 and B15 lamp holders.

In order to allow the creation of a dependable latching system for very small types of bayonet fittings and to maintain the required minimum distances between the current-carrying components, the invention proposes a ring-shaped, spring-loaded plastic element with appropriate latching arrangements as a reversing lock.

To understand better the scope and the nature of the invention, some design examples of a touch-safe lamp holder and adapter system according to the invention are described below. The descriptions are to be regarded only as examples, and are in no way to be construed as limiting.

BRIEF DESCRIPTION OF THE DRAWINGS

FIG. 1 and FIG. 2 show the application of a filament lamp with a new pin-type socket with adapters for use in conventional lamp holders.

FIG. 3 shows a modern helicoidal fluorescent lamp with pin-socket in combination with the substantially smaller-design safety lamp holder according to the invention.

DETAILED DESCRIPTION OF THE INVENTION

Figure 8:
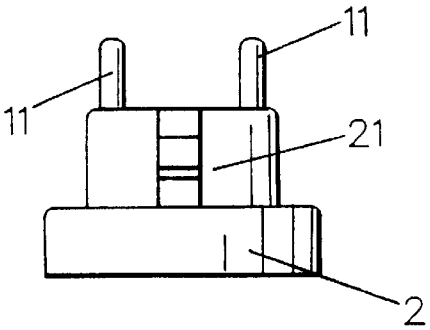

An exact description of the examples is given below showing how the scope and nature of the invention is realized.

The principle of the adapter system is represented in FIGS. 1 and 2 in an easily understandable fashion. A filament lamp (1) is already equipped with a pin-type socket (2) with hollow pins (11) according to the invention. In order for the pins to be fitted into the previous conventional, non-shockproof lamp holder (3), one requires either a large screw-type adapter (27), or a large bayonet adapter (22).

The drawings demonstrate that there is hardly any increase in the installed length of the lamp by using the adapter according to the invention. All of the necessary components are contained in the adapters (27) or (22). In both cases, the actual lamp holder system according to the invention is positioned behind the front plate (8) inside the previous lamp socket, which is described later in great detail.

Figure 4:
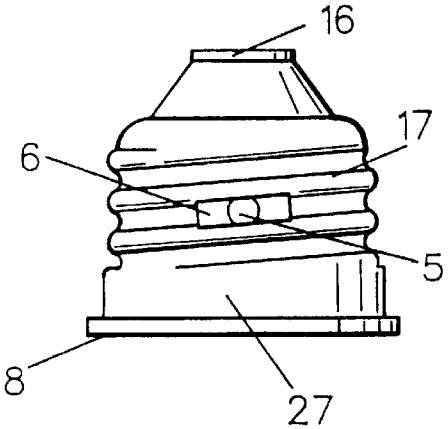

For the large screw-type adapter (27), only the latching device can be seen on the outside, which in the example of FIG. 4, consists of a ball (5) which projects through a window (6).

For the large bayonet adapter (22) for large B22 holders (23), two latches (7) for the positioning in the holder are visible in addition to the usual pins (9), which project from the bayonet adapter (22).

By comparison, FIG. 3 shows the future design of a touch-safe lamp holder by way of an example of a fluorescent lamp (4), where the pin-type socket (2) is molded onto the housing (13), together with its two hollow pins (11).

A comparison of the sizes shows the huge advantages of the new socket and lamp holder system. The material input is substantially reduced, which results in a considerable cost advantage.

Especially with compact lamps, where the pin socket (2) is already connected to the housing (13), the overall cost for the new pin holder is reduced to the cost of the two hollow pins (11), which represents only a fraction of the cost of the previous construction.

Figure 9:
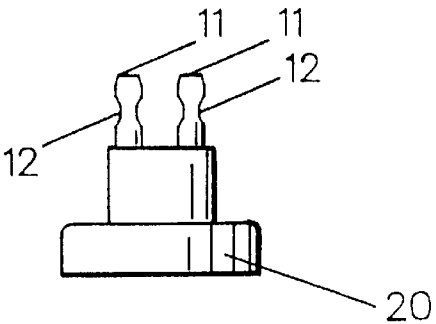

Moreover, as shown in FIG. 9, the pin sockets (2) according to the invention can be provided with a stem press (12), which not only serves to latch the socket in the lamp holder, but at the same time also serves as the connection for the hollow pins (11) to the power cord for the lamp.

If one considers the many billions of filament lamps that are manufactured yearly, and which until now have two solder joints, then this rationalization advantage alone would save thousands of tons of solder as well as resulting in enormous energy savings, because the heat energy needed for soldering is no longer required.

According to the invention, the new touch-safe lamp holder and adapter system provides for only two design sizes, namely, a large pin-type socket (2) which together with a large screw-type adapter (27) or a large bayonet adapter (22) replaces both of the previous, non-shockproof lamp holders, and one small touch-safe holder (10) as well as a large touch-safe lamp holder (19).

The small pin-type socket (20), as shown in FIG. 9, can replace both of the previous non-shockproof lamp holders, either with the small screw-type adapter (14) or with the small bayonet adapter (15).

The rationalization of replacing four holder systems with two lamp holders has a significant economic advantage, particularly for countries where both lamp-holder systems—screw-type and bayonet type—are used.

Since the dimensions of the large screw-type adapter (27) (FIG. 4) correspond approximately to the current E14 lamp holders, even the lamps which were so far designed for lamp holders E14 or B15, can be equipped with the new four-pin sockets, which—as stated—are not larger than current E14 sockets. Thus, it is possible to replace all four types of sockets with a single new pin-type socket.

Figure 6:
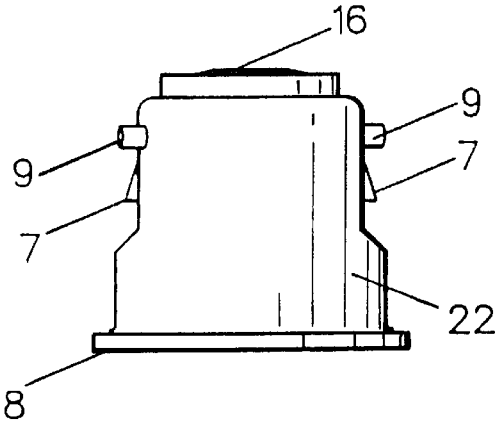
FIGS. 4–7 show presentations of adapters for the new lamp sockets depicted in FIGS. 8 and 9.

FIGS. 4 and 6 show an enlargement of the adapters already described in FIG. 1 and FIG. 2, whereby identical parts are numbered with identical reference numbers.

Figure 7:
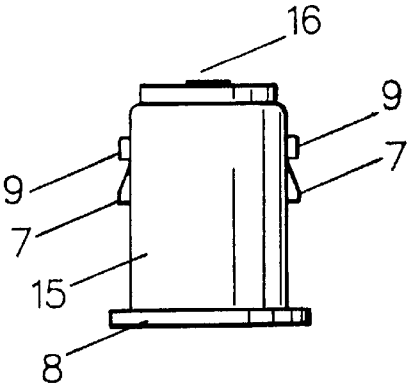
Figure 5:
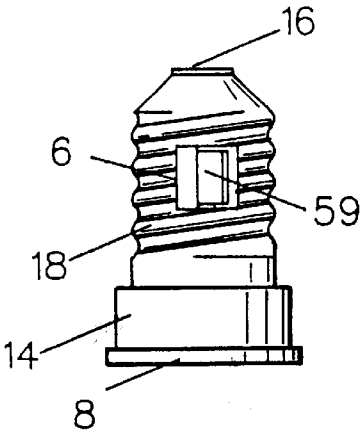

FIGS. 5 and 7 on the other hand only show the small adapter; FIG. 5 the small screw-type adapter (14), and FIG. 7 the small bayonet adapter (15).

In FIG. 5 a leaf spring is shown as the retaining spring (59) for the reversing lock in a window (6).

The lamp holders require corresponding sockets. FIG. 8 shows an example of a pin-type socket (2) with its hollow pins (11) and a latch profile (21) which is shown in a side view in FIG. 19.

For the small adapters, as shown in FIGS. 5 and 7, a small pin-type socket (20) is provided, as shown in FIG. 9. In this example, the hollow pins (11) are provided with stem presses (12), which can serve as the wire connection for the lamps, as well as for latching the socket in the lamp holder.

The following presentations in FIGS. 10 to 18 show examples of the adapters according to the invention, illustrating the contact system, the latch, the locking system and the possibilities for unlatching.

Figures 10, 11, 12, 13:
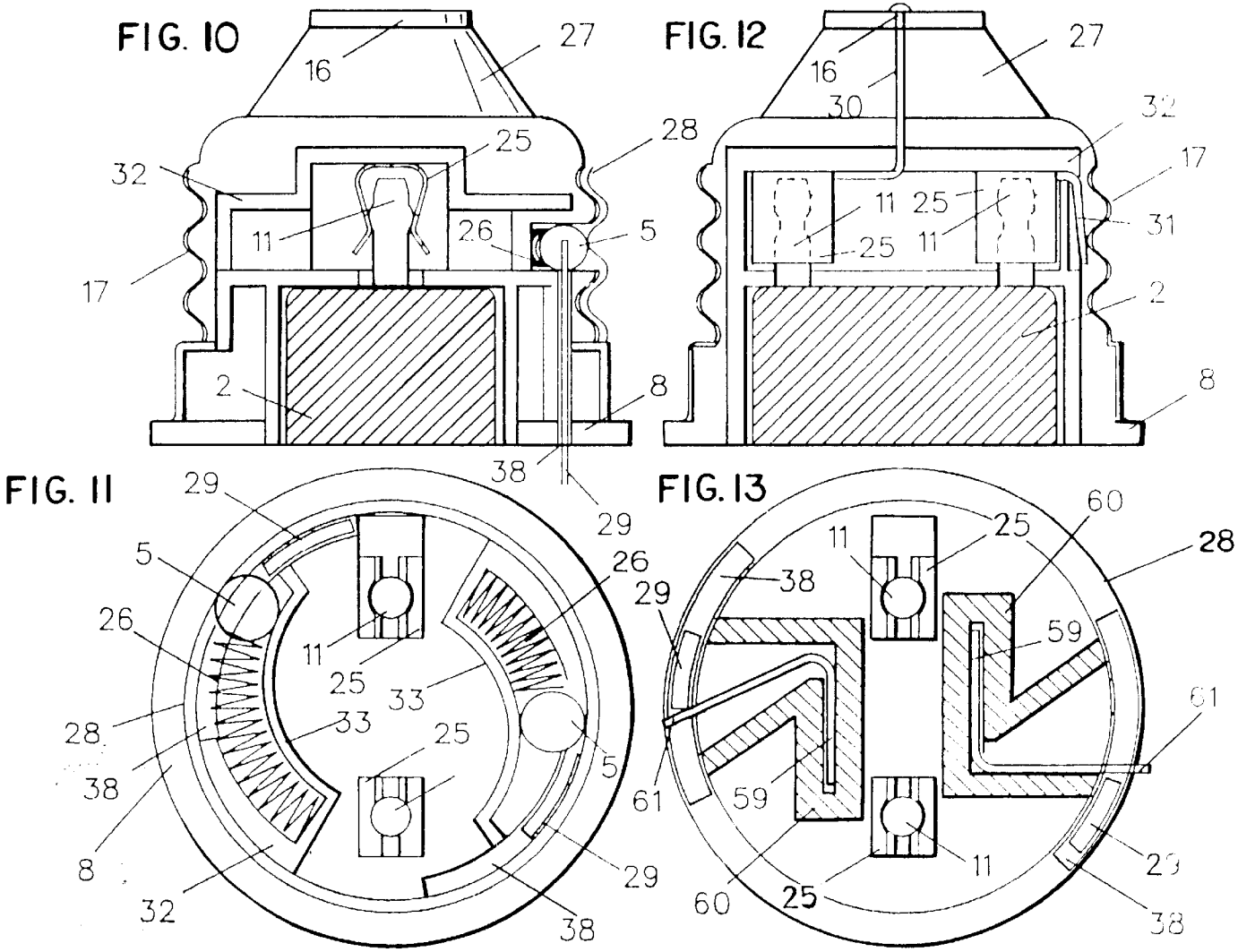
FIGS. 10–13*a* is a schematic presentation of the assembly of an adapter for E27.

A Lyra contact (25) has been provided as the contact system in FIG. 10, which encloses the lateral stem-pressed hollow pin (11) enabling electrical contact as well as a clearly noticeable engagement of the latch. In this example, the Lyra contact (25) latches onto the widening or shoulder at the hollow pin (11), which is created as a result of the stem press (12) (FIG. 9). This is a technologically equivalent lock mechanism compared with the example in FIG. 21, where the locking takes place in the reduced cross section that is created by the stem press.

As shown in the section of FIG. 12, the Lyra contacts (25) can be connected in a simple fashion to the power source contact (16) by means of a connection tag (30). A connection between the right Lyra contact (25) and the E27 thread (17) can be achieved economically and without soldering via the spring contact (31).

The reversing lock is shown in its blocked position in the left portion of the sectional drawing of FIG. 11. There the ball (5) lies on the inside surface (28) of the lamp holder E27 under the pressure of the springs (26), thus preventing the unscrewing of the adapter from the previous non-shockproof holder. This jams the ball (5) into the spiral-shaped gap which narrows in the direction of screw-turn, between the inside wall (28) of the screw-type thread and the spiral-shaped track (33). Furthermore, the inside surface (28) of the lamp holder E27, which is not shown, and into which the adapter is screwed, is also indicated in FIG. 10, where the close contact of the ball (5) with this surface can be clearly observed.

Should it become necessary to remove the adapter from the lamp holder, then a special bifurcated tool (29) can be inserted through the gap (38) in the front plate (8), as can be observed in FIG. 10, and in the right section of FIG. 11.

The special tool (29) lies in front of the balls (5), as shown in FIG. 11. If, during the unscrewing of the adapter—as shown in the right section of FIG. 11—the special tool (29) is turned anti-clockwise, then the balls (5) will initially be pushed back against the resistance of the springs (26) and upon arriving onto the spiral tracks (33), lose contact with the inside surfaces (28) of the lamp holder E27. This loosens the latching, and the adapter can now be easily unscrewed from the E27 thread with the help of the special tool (29).

The spiral tracks (33) are part of the plastic housing (32) and can thus be very easily molded. Since the reversing locks, even if they are arranged in diametrically opposite pairs, only require a limited angular section, it is possible to accommodate Lyra contacts (25), as well as any required terminals with their connections (30) or with the spring contact (31) in the same plane.

Another version of a reversing lock utilizing a leaf spring is represented in FIG. 13. In this case, the protruding end (61) of the retaining spring (59) initially projects over the inside surface (28) of the lamp holder. During the fitting of the adapter into the conventional screw-type lamp holder, the protruding end (61) of the retaining spring (59) is pushed back against the elastic spring pressure, and now lies against the inside surface (28) of the holder, as shown in the left section of FIG. 13.

If one attempts to unscrew the adapter in a counterclockwise direction, the protruding end (61) of the retaining spring (59) hooks into the inside surface (28) of the screw-type lamp holder and prevents it from being unscrewed. Only if the protruding end (61) of the retaining spring (59) is pushed back counterclockwise with the special tool (29), is the locking effect canceled, and the adapter can be unscrewed from the screw-type lamp holder.

The effect of the spring lock can be compared to that of the function of similar springs in screwless wire clamps, where the same kinematic procedure results in a reliable clamping effect of the wires.

Figure 13A:
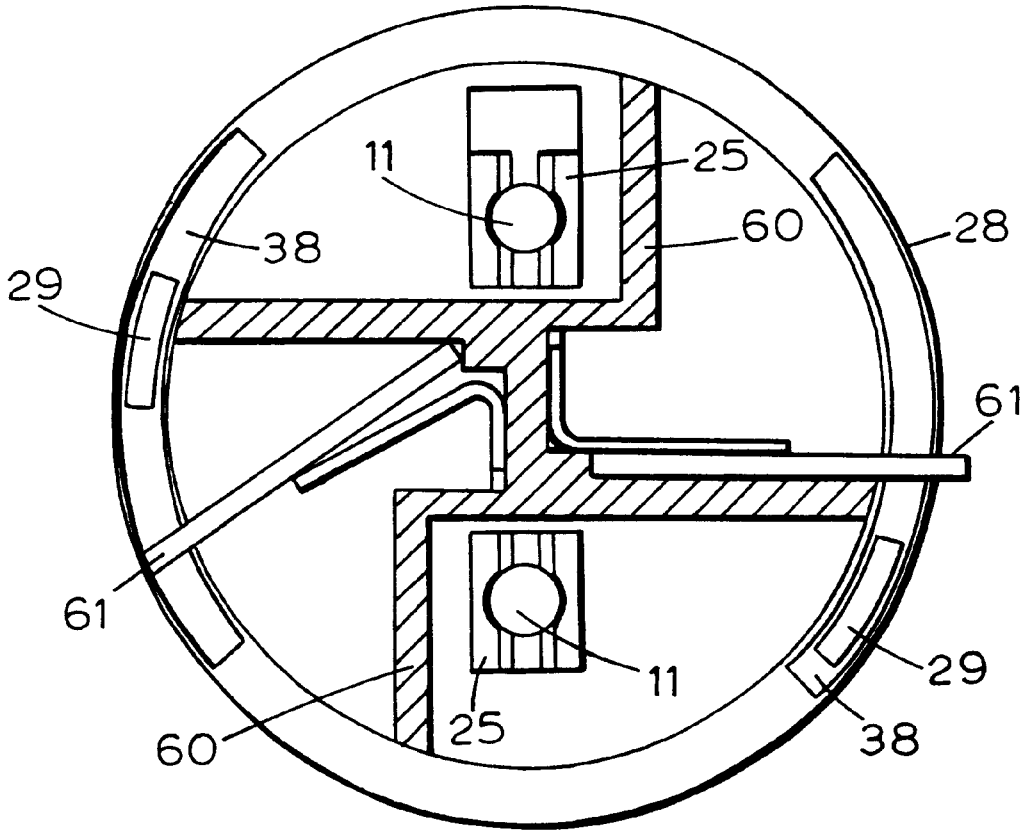

Another practical example of an unscrewing lock for screw-type holders is shown in FIG. 13*a*. A rigid lever (64) is supported eccentrically in a holder (60) in the adapter in such a way that, depending on its angular position, it protrudes through window (6) in the threaded sleeve or remains within the peripheral contours of the adapter. Both positions of the lever (60) are shown in FIG. 13*a*. In the left half, the lever (60) is under the pressure of the spring (65) on the inside surface (28) of the screw-type holder. If one now tries to unscrew the adapter from the holder, due to its eccentric position (66) in the adapter, the lever (60) presses the adapter against the opposing inside surface (28) of the lamp holder and jams the two parts against one another immovably. This effect is further enhanced by the force of the spring (65), the primary purpose of which is to provide a permanent contact between the lever (60) and the inside surface (28) of the lamp holder.

Depending on how large the eccentricity of the position (66) is chosen, the lever (60) can provide either a braking force or complete blockage.

In the right half of FIG. 13*a,* the lever (60) is shown before the adapter is screwed into the lamp holder. The protruding end of (61) of the lever (60) can be seen clearly.

The example of a reversing lock for bayonet holders is shown in FIGS. 14–18*a*.

Figures 14, 15, 16, 17, 18, 18A:
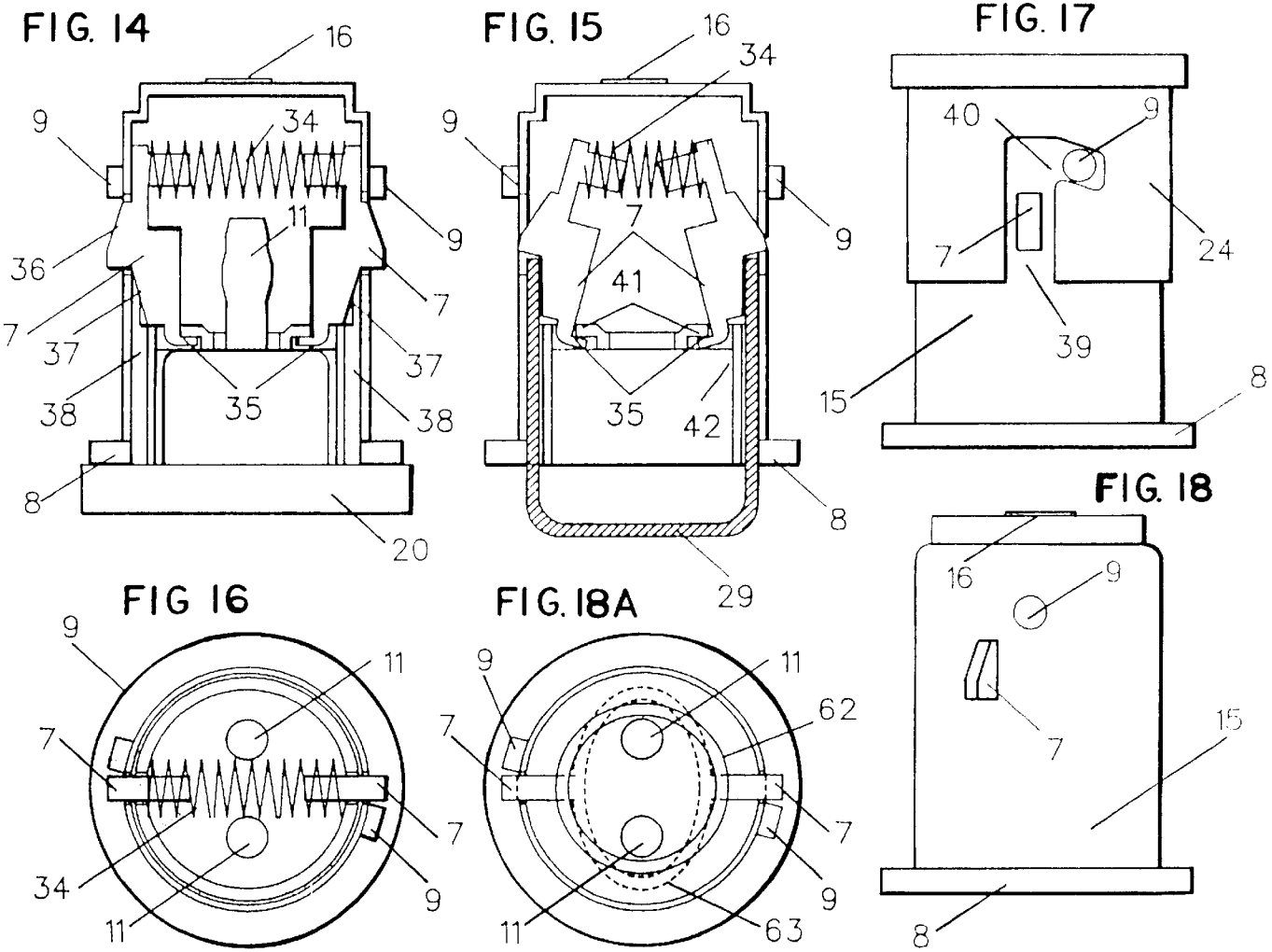
FIGS. 14–16 likewise show schematically the assembly of the latching device of a bayonet holder.
FIGS. 17 and 18 show an adapter for bayonet lamp holders before and after insertion into the lamp holder.
FIG. 18*a* shows an example of a ring-shaped spring-loaded latching element.

This practical example shows two radially movable latches (7), which are positioned in the openings (41) with hooks (35), and which are initially put into a position as shown in FIG. 14, as a result of the exerted spring (34) pressure. They project out of the large bayonet adapter (22), as also shown in FIG. 18. If the adapter—in the case represented here it is the small bayonet adapter (15)—is fitted into a B15 lamp holder (24), then initially the pegs (9) in the guide slot (39) have to be pushed in until they lock into the retaining hook-shaped section (40). During this action, the latch (7), which is offset at an angle against the pegs (9) on the perimeter of the small bayonet adapter (15), slides along the inside surface of the B15 lamp holder (24). The insertion of the bayonet adapter (15) is made easier, because the faces (36) of the latches (7) are beveled, and can thus retract during the insertion.

Only after the pegs (9) are fully pushed into the guide slot (39) and after screwing into the retaining hook section (40), the latches (7) arrive into the area of the guide slots (39), snap into the guide slots (39) under the pressure of the spring (34) and thus reliably prevent an unscrewing of the bayonet adapter from the B15 holder (24).

Similarly to the reversing lock of the screw-type adapters (14) and (27), it is also possible to undo the lock for the bayonet adapters (15) and (22) with the help of the special tool (29). This is shown in FIG. 15. In this case, the special tool (29) pushes back the latches (7) across the beveled edges (37), so that the pegs (9) can be turned again in the guide slots (39), so that the bayonet adapter (15) can be removed from the B15 lamp holder (24).

This angular offset of the latches (7) against the pegs (9) can be clearly seen in the section FIG. 16. Also the position of these parts with reference to the hollow pins (11) shows that these devices do not interfere with each other. This can also be seen in FIG. 14, where the pin-type socket (20) with the pins (11) are shown in their installed position.

A significantly simplified version of a reversing lock for adapter holders is represented in FIG. 18*a*. In this case, a ring-shaped spring element (62), which is preferably made of plastic, takes over all of the tasks of the previously described arrangement. The ring-shaped spring element (62) also has two latches (7) which project in the form of projections out of the adapter. During the installation of the adapter, the latches are pushed back and thus carry out the above-mentioned functions. These latches (7) are also beveled, as shown in FIG. 18, which makes it easier for the lamp holder to be installed. Because of the deformation of the ring-shaped spring element (62) during the insertion into the holder as well as during the unlatching with the special tool (29)—as previously described—the ring-shaped element acquires an oval shape (63) and subsequently springs back elastically into its original shape.

The depicted example of a ring-shaped spring element (62) as a closed ring is to be understood as a substitute for all other possible versions of a similar component of this type, be it a half-ring, a corrugated component, or part of a calotte shell; in each case with the latches (7) as projections.

FIGS. 14–18 also clearly show that the installed length of the bayonet adapter (15) from the power source contact (16) to the front plate (8) does not require any additional length.

Figure 19:
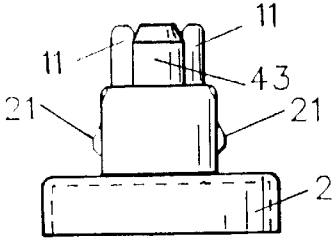
Figure 20:
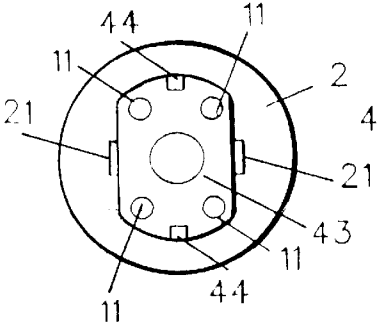

FIGS. 19 and 20 give examples for the layout of a code, used, for example, to prevent the installation of lamps with a 110 volt rating into a 220 volt holder. This is especially important for countries where not only different lamp holder systems, but also different line voltages are in use. Such codes could be provided as a center code (43), or as a code (44) on the perimeter of the pin-type socket (2). The large pin-type socket (2), shown in the example, also allows the grouping of four hollow pins (11) to enable the connection for lamps with multiple filaments, for instance.

Figure 21:
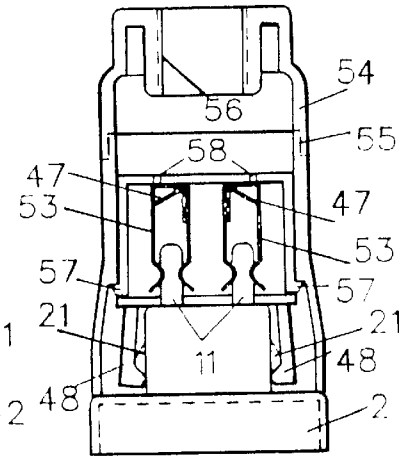
FIGS. 19–22 are a schematic presentation of the mounting of the coding devices and the mechanical latching, which fix the positioning of the sockets inside the lamp holder.

Latch profiles (21) are also provided at the socket, which, as shown in FIG. 21, secure the position of the plugged-in socket in the lamp holder by way of snap locks (48) which should be molded directly into the plastic body.

FIG. 21 still shows additional details of the touch-safe lamp holder, according to the invention.

In this example, in addition to the latch profiles (21) and the snap locks (48), the hollow pins (11) provided with stem press latches also serve as selective or additional latches. The latching takes place in the Lyra contacts (53), which moreover are provided with a compression clip (47) in order to obtain a screwless connection to the power cord via the power supply lines (58).

The lamp holder also has a cap (54), which, for instance, can be screwed-on with a thread (55). A thread (56), offers the possibility for the conventional installation of the lamp holders into light fittings.

All component parts of this example can of course be modified, i.e., a snap connection (57) is recommended to make the installation of the lamp holder more user-friendly.

Figure 22:
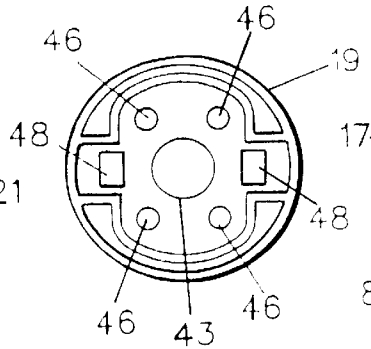

FIG. 22 shows a view of the large touch-safe lamp holder (19) in the direction of the insertion of the lamp socket. FIG. 22 shows the four holes (46) for the pins, as well as the snap locks (48). Also shown is a peg (43) as code in the center.

Since the touch-safe lamp holder and adapter system is intended to be suitable for all types of applications, further examples are shown in FIGS. 23–26.

Figure 23:
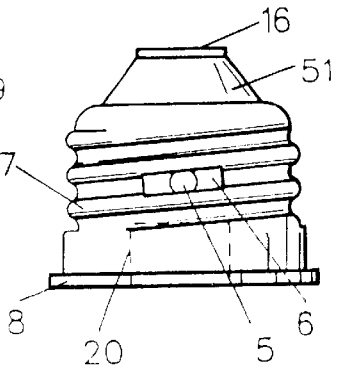

FIG. 23 is an adapter (51) for the small pin-type socket (20), in order to enable the use of candle lamps with small pin-type sockets into large E27 lamp holders.

Figure 24:
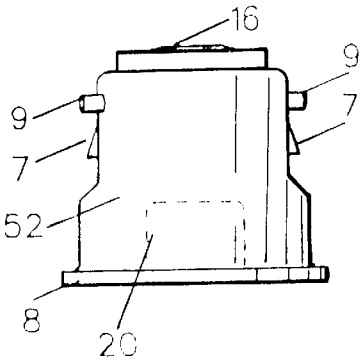
FIG. 23 and FIG. 24 show examples of adapter reducers.

FIG. 24 is such a solution of an adapter (52) for B22 lamp holders, to facilitate the use of small pin-type sockets.

Figure 26:
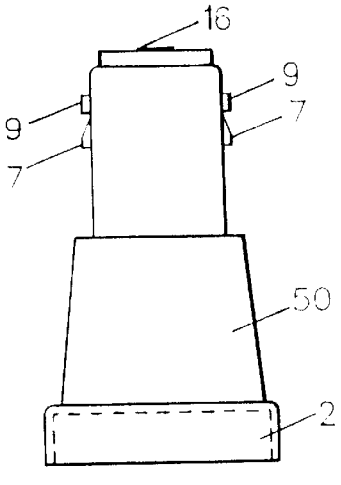
FIGS. 25 and 26 show examples of the application of large pin-sockets in the previous, non-shockproof E14 and E15 lamp holders.
Figure 25:
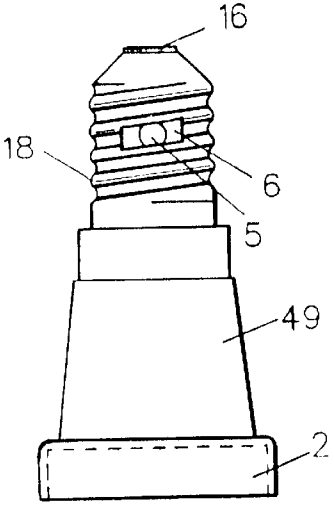

FIGS. 25 and 26 provide the opposite solution, so that large pin-type sockets (2) can be fitted into small screw-type or bayonet lamp holders by means of an adapter (49 and 50).

All of the components in the figures mentioned are marked with the appropriate identification numbers.

The data for providing solutions according to the invention are so comprehensive, that all of their different versions cannot be described, irrespective of whether these are for the type of pins, the type of latching or other details, so that, for instance, examples of the touch-safe lamp holders and sockets with a bayonet latching instead of the latchings described are deemed to be included under the indirect scope of protection of this invention.

What is claimed is:

1. A shockproof adapter for supplying power to a lamp equipped with a pin-type socket, said socket having a plurality of pin contacts, said shockproof adapter comprising:

an adapter perimeter surface adapted to facilitate mounting of said adapter within a lamp holder;

a power source contact on said adapter for connecting the adapter to a source of electrical power;

an electrical contact system within said adapter, said adapter electrical contact system comprising latch for engaging the pin contacts on the lamp pin-type socket; and a locking element on said adapter perimeter surface for securing said adapter within said lamp holder.

2. The shockproof adapter of claim 1 wherein said locking element comprises a spring-loaded movable latch which is adapted to frictionally contact an interior wall of said lamp socket.

3. The adapter of claim 1 wherein said lamp holder is selected from the group consisting of lamp socket types B15, B22, E14 and E27.

4. A touch-safe lamp holder and adapter system for lamps, comprising:

a) a bayonet lamp holder having a latching slot in the interior thereof; and b) an adapter having an outer perimeter surface adapted to fit within said bayonet lamp holder, said adapter comprising:

i) a peg on the perimeter surface of said adapter adapted to fit within said lamp holder latching slot;

ii) a power source contact on said adapter for connection to a source of electrical power;

iii) an electrical contact system within said adapter for supplying power to pin contacts inserted into said adapter; and iv) a reversing lock on the perimeter surface of said adapter for holding said adapter within said bayonet lamp holder, said reversing lock capable of being released with a tool.

5. A touch-safe lamp holder and adapter system for lamps, comprising:

a) a lamp holder;

b) an adapter comprising:

i) an adapter perimeter surface, said perimeter surface adapted to fit within said lamp holder;

ii) a power source contact on said adapter for connection to a source of electrical power;

iii) an electrical contact system within said adapter for supplying power to pin contacts inserted into said adapter; and iv) a reversing lock on the perimeter surface of said adapter for holding said adapter within said lamp holder; and c) a lamp having a pin-type socket, said pin-type socket having a plurality of pin contacts adapted to mate with said adapter electrical contact system.

* * * * *